US007219608B2

(12) United States Patent
Sung

(10) Patent No.: US 7,219,608 B2
(45) Date of Patent: May 22, 2007

(54) FOOD PREPARATION TABLE

(75) Inventor: Ki Rin Sung, Seoul (KR)

(73) Assignee: Daewoo Electronics Corporation (KR)

( * ) Notice: Subject to any disclaimer, the term of this patent is extended or adjusted under 35 U.S.C. 154(b) by 225 days.

(21) Appl. No.: 10/612,374

(22) Filed: Jul. 1, 2003

(65) Prior Publication Data

US 2004/0168616 A1 Sep. 2, 2004

(30) Foreign Application Priority Data

Feb. 28, 2003 (KR) ..... 10-2003-0012832
Feb. 28, 2003 (KR) ..... 10-2003-0012833

(51) Int. Cl.
*A47B 37/00* (2006.01)

(52) U.S. Cl. ..... 108/50.11; 312/405

(58) Field of Classification Search ..... 16/358, 16/357, 361, 332; 108/25, 26, 50.15; 312/140.1, 312/228, 229, 326, 327, 328, 329
See application file for complete search history.

(56) References Cited

U.S. PATENT DOCUMENTS 1,987,516 A * 1/1935 Peremi et al. ..... 16/240
2,143,704 A * 1/1939 Kufner ..... 16/358
2,210,762 A * 8/1940 Itzigson ..... 296/97.9
2,227,871 A * 1/1941 Wigell ..... 403/65
2,321,695 A * 6/1943 Miller ..... 62/248
2,435,670 A * 2/1948 Buehler ..... 220/815
2,898,173 A * 8/1959 Squire ..... 312/248
3,038,196 A * 6/1962 Nyquist ..... 16/358
3,816,234 A * 6/1974 Winfield ..... 428/317.9
3,853,597 A * 12/1974 Shimizu et al. ..... 427/379
4,151,681 A * 5/1979 Roberts ..... 49/382
4,649,599 A * 3/1987 Beller ..... 16/332
4,771,907 A * 9/1988 Torney ..... 220/23.83
5,117,649 A * 6/1992 Mangini et al. ..... 62/251
5,210,888 A * 5/1993 Canfield ..... 5/113
5,408,725 A * 4/1995 Wolanin ..... 16/239
5,415,010 A * 5/1995 Woo ..... 62/258
6,209,265 B1 * 4/2001 Banicevic et al. ..... 49/501

* cited by examiner

*Primary Examiner*—David R. Dunn
*Assistant Examiner*—Noah Chandler Hawk
(74) *Attorney, Agent, or Firm*—Anderson Kill & Olick, PC

(57) ABSTRACT

A food preparation table of the present invention includes a pan holder for accommodating pans; an insulated wall surrounding the pan holder; even number n of brackets fixed on the insulated wall; n/2 covers, each having a pair of first hinge axles and a pair of second hinge axles on opposite sides thereof, wherein the pair of first hinge axles and the pair of second hinge axles are slidably engaged with the brackets. The pair of first hinge axles and the pair of second hinge axles are inserted to a pair of plates attached to the opposite sides of the cover. Each of the brackets includes a slanted guide surface for guiding corresponding first hinge axle, wherein the pair of the first hinge axles are closer to a front portion of the cover than the second hinge axles.

5 Claims, 5 Drawing Sheets

FOOD PREPARATION TABLE

FIELD OF THE INVENTION

The present invention relates to a food preparation table; and more particularly, to a food preparation table which is capable of simplifying its hinge axle assembling process and reducing its manufacturing cost, and capable of allowing an operator to open a cover disposed on a pan holder with comparatively less force and to feel more comfortable in handling the cover by employing a slanted guide surface in a bracket.

BACKGROUND OF THE INVENTION

As well known, widely used for preparing pizza, sandwich or salad, a food preparation table includes a horizontally disposed counter top for providing a place on which foodstuff is prepared; a pan holder disposed adjacent to the counter top, which accommodates a plural number of pans containing ingredient foodstuff items, e.g., sliced tomatoes and lettuces; one or more covers for covering or exposing the pan holder; a food storage compartment which is provided with a plural number of doors in a front thereof and refrigerates other items; and a refrigerating system which supplies cooled air into the food storage compartment and the pan holder.

Each cover is connected to an upper portion of an insulating wall surrounding the pan holder by means of hinge axles and brackets, so that it can open or close. When the ingredient foodstuff items in the pans disposed in the pan holder are used for preparing foodstuff, the covers are open. And while the ingredient foodstuff items are not used, the covers close the pan holder, so that the cooled air in the pans can be prevented from contacting with the ambient warm air.

Referring to FIG. 1, there is illustrated an exploded perspective view of a conventional cover. The cover 50' is provided with an upper case 30 made of stainless steel, an insulated pad 20 disposed inside the upper case 30, a lower case 10 covering a bottom portion of the insulated pad 20 and a pair of first and a pair of second hinge axles 35*a*, 35*b*. The lower case 10 is coupled to the upper case 30 by a plural number of bolts 34 screwing into openings 32 formed in both sides of the upper case 30 and rivet screws 22 built in both sides of the lower case 10. The first and the second hinge axles 35*a*, 35*b* are disposed on rear portions of the both sides of the upper case 30 in a manner that the first hinge axles 35*a* are closer to a front portion of the upper case 30 than the second hinge axles 35*b*. The first and the second hinge axles 35*a*, 35*b* are provided with external thread portions 24*a*, 24*b* projecting from the both sides of the upper case 30 and internal thread portions 26*a*, 26*b*, wherein the internal thread portions 26*a*, 26*b* are screwed onto the external thread portions.

However, such a cover has some drawbacks. First, since the rivet screws 22 are built in the sides of the lower case 10, an assembling process of the cover 50 requires relatively long time, which deteriorates a productivity in the mass production.

Referring to FIG. 2, there is illustrated a perspective view of a conventional bracket with which a pair of the hinge axles 35*a*, 35*b* are movably engaged. The bracket 40 is provided with a bottom surface 41 which has a flange f attached to an upper portion of the insulated wall surrounding the pan holder; a vertically oriented guide surface 42 which guides the first hinge axle 35*a* vertically when the cover 50 is opened or closed; a slant face 44; and a round portion 43 which is disposed at a corner formed with the guide surface 42 and the slant face 44. The slant face 44 is provided with a latch slot 45 which keeps the cover 50 open, and a slantingly oriented guide slot 46 in which the second hinge axle 35*b* is slidably fitted. The latch slot 45 is formed in an upper portion of the slant face 44 and the guide slot 46 in a lower portion thereof.

As shown in FIG. 2, when the cover 50 is closed, the first hinge axle 35*a* is positioned at a lower portion of the guide surface 42 and the second hinge axle 35*b* at a lowest portion of the guide slot 46. When the cover 50 is opened, as shown in dotted line, the first hinge axle 35*a* is vertically lifted along the guide surface 42 and the second hinge axle 35*b* is moved upward in the guide slot 46. Therefore, since the first hinge axle 35*a* is moved vertically and the entire cover 50 is lifted, great force is required to open the cover 50. In addition, since the first hinge axle 35*a* is moved vertically, it collides severely with the upper portion of the pan holder when accidentally dropped from opening state, which may cause damage on both.

SUMMARY OF THE INVENTION

It is, therefore, an object of the present invention to provide a food preparation table which is capable of simplifying an assembling process of a cover and capable of covering or exposing a pan holder with comparatively less force.

In accordance with a preferred embodiment of the present invention, there is provided a food preparation table, comprising: a pan holder which accommodates pans containing ingredient foodstuff items; an insulated wall surrounding the pan holder; n brackets fixed on the insulated wall, n being an even positive number; and n/2 covers for covering or exposing the pan holder, each of the covers having: two opposite sides having a pair of openings, respectively; a pair of first hinge axles; a pair of second hinge axles; and a pair of plates, each having a pair of openings and being attached on one of said two opposite sides, wherein distal end portions of the pair of the first hinge axles and the pair of second hinge axles are slidably engaged with two brackets among said n brackets and the rest of end portions of the pair of the first hinge axles and the pair of second hinge axles are fixedly inserted into the openings of the pair of plates further through the openings formed in said two opposite sides.

In accordance with another preferred embodiment of the present invention, there is provided a food preparation table, comprising: a pan holder which accommodates pans containing ingredient foodstuff items; an insulated wall surrounding the pan holder; n brackets fixed on the insulated wall, n being an even number; and n/2 covers for covering or exposing the pan holder, each of the covers including: two opposite sides; a pair of first hinge axles which are attached on said two opposite sides, respectively; and a pair of second hinge axles which are attached on said two opposite sides, respectively, wherein the pair of first hinge axles are closer to a front portion of each of the covers than the pair of second hinge axles, and wherein distal end portions of the first hinge axles and the second hinge axles are slidably engaged with two brackets among said n brackets and each of the brackets includes a guide surface for guiding one of the first axles, which is at a slant.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

A food preparation table in accordance with a preferred embodiment of the present invention will now be described with reference to the accompanying drawings.

Figure 1:
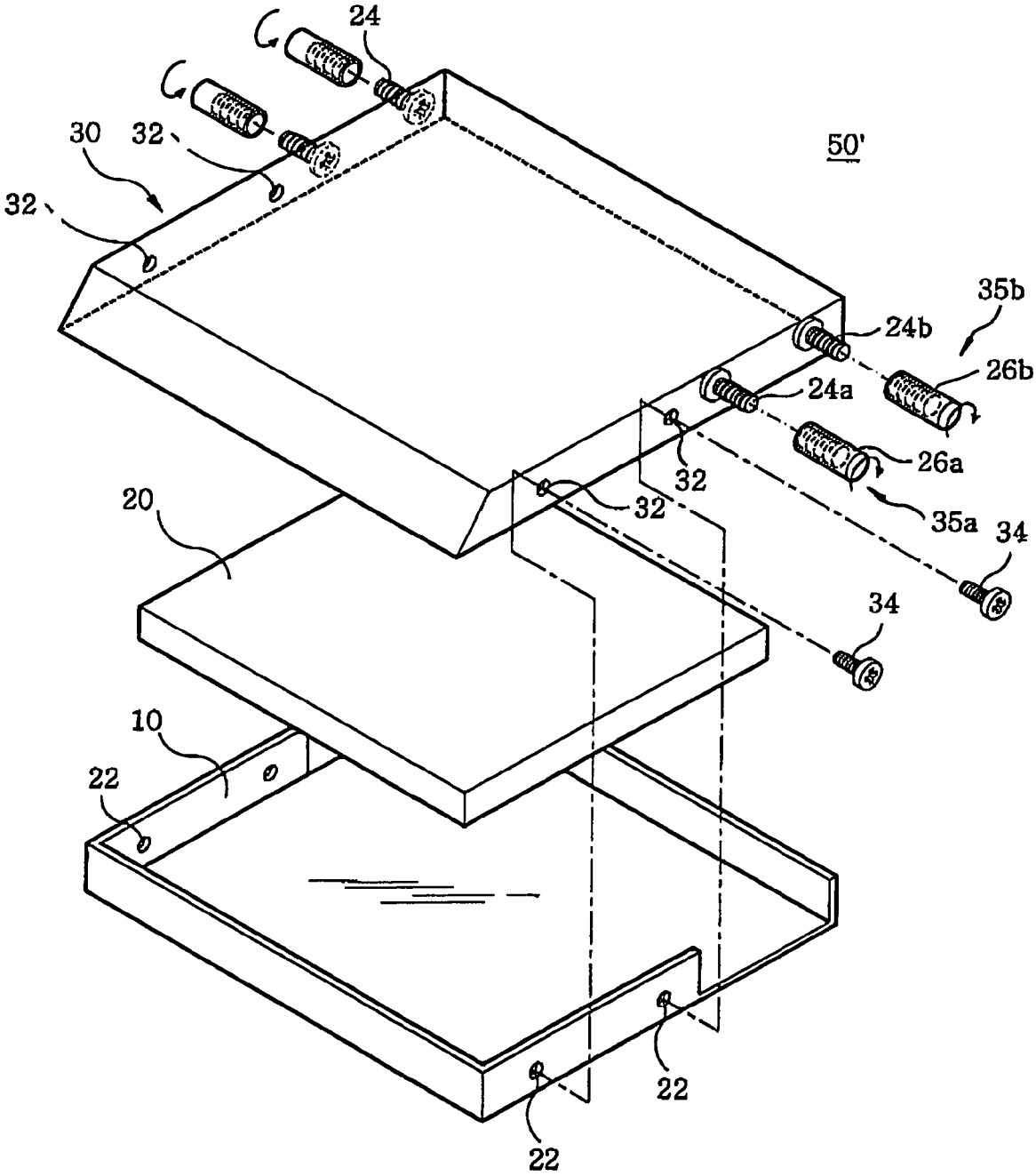
FIG. 1 (PRIOR ART)
FIG. 1 is an exploded perspective view of a conventional hood lid.
Figure 2:
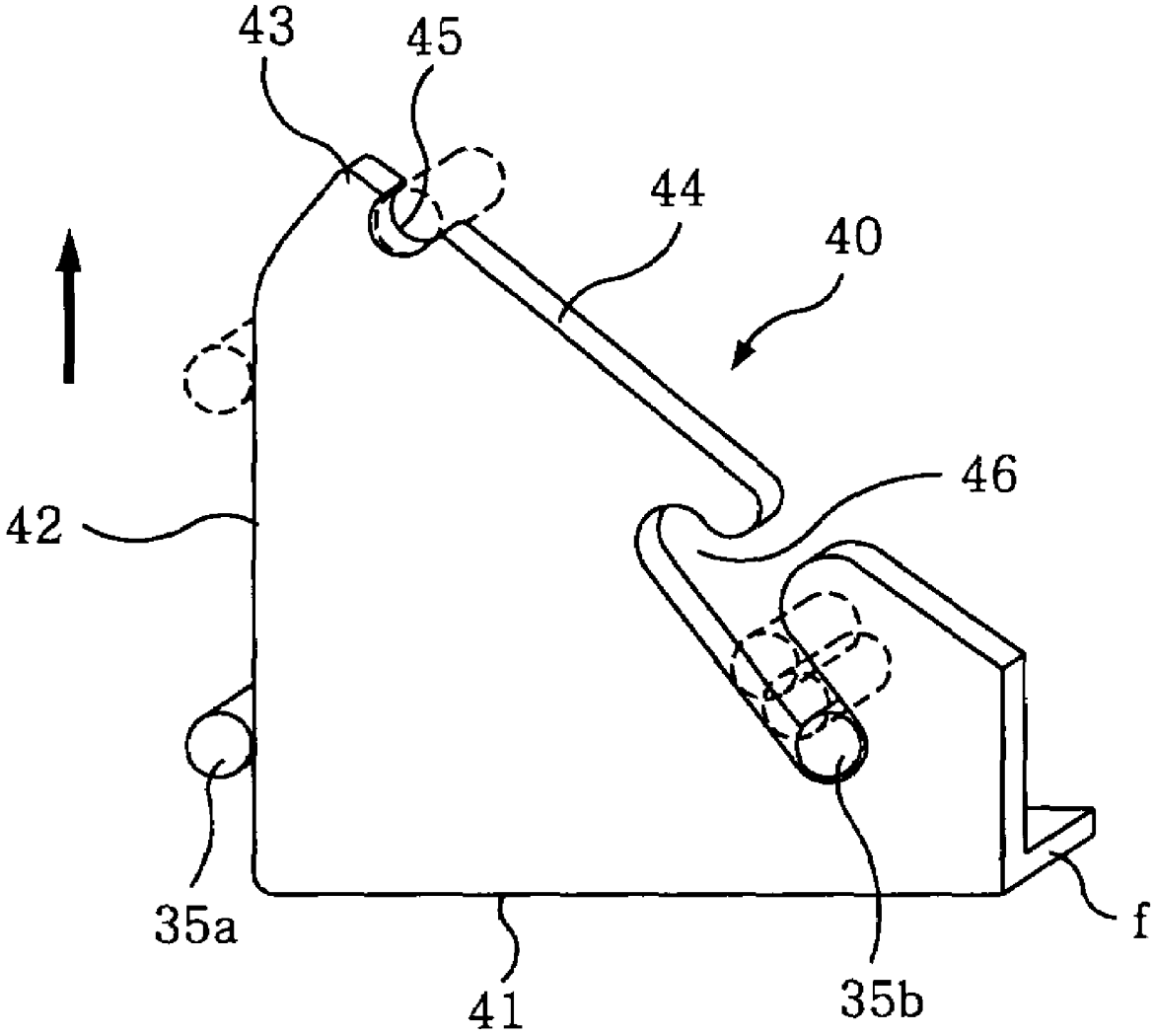
FIG.2 (PRIOR ART)
FIG. 2 presents a perspective view of a conventional bracket.
Figure 3:
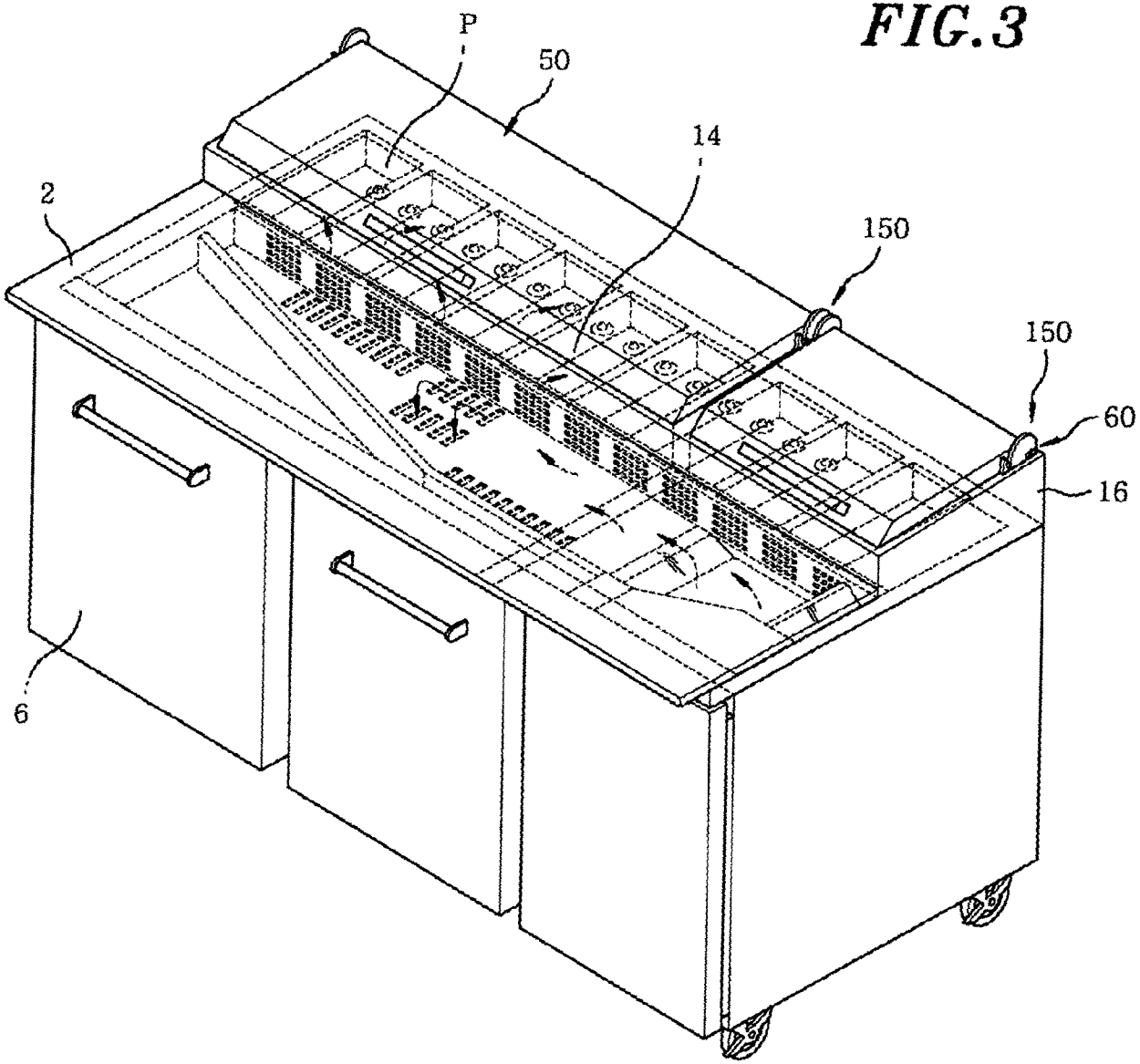
FIG. 3 schematically depicts a perspective view of a food preparation table in accordance with a preferred embodiment of the present invention.

Referring to FIG. 3, there is schematically illustrated a perspective view of a food preparation table in accordance with a preferred embodiment of the present invention. The food preparation table includes a horizontally disposed counter top 2 for providing a place on which foodstuff is prepared; a pan holder 14 which is disposed on the backside of the counter top 2 and accommodates a plural number of pans P containing ingredient foodstuff items, e.g., sliced tomatoes and lettuces; a food storage compartment 6 which is provided with a pair of doors in a front thereof and preserves other items; a refrigerating system (not shown) which supplies cooled air into the food storage compartment 6 and the pan holder 14; an insulated wall 16 surrounding the pan holder 14; two pairs of brackets 150 fixed on the upper portion of the insulated wall 16; and two covers 50 which are pivotally supported by the corresponding pair of brackets 150, respectively, and cover or uncover the pan holder 14.

Figure 4:
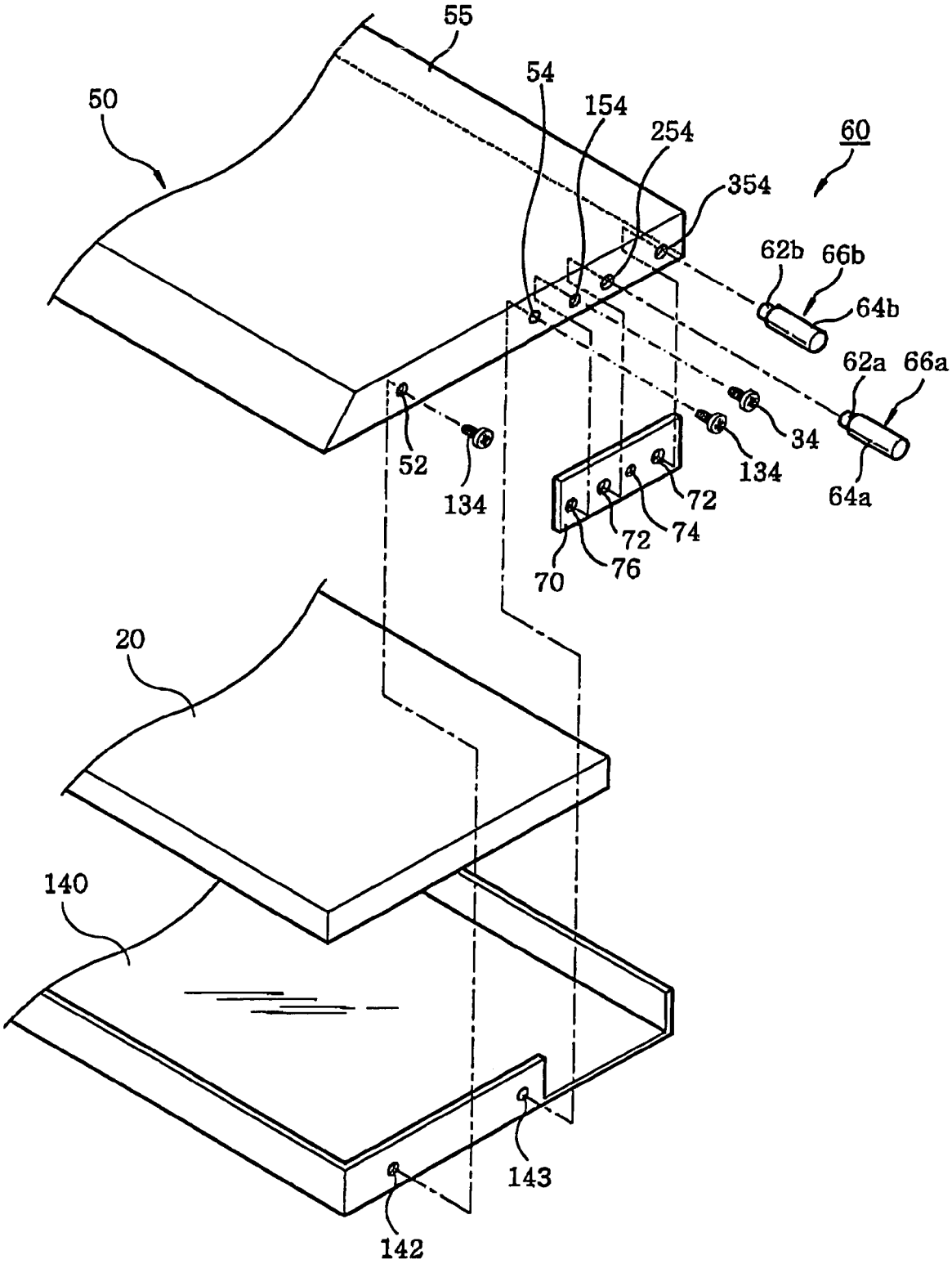
FIG. 4 offers an exploded perspective view of a portion of cover of the present invention.

Referring to FIG. 4, there is illustrated an exploded perspective view of a portion of cover 50. The cover 50 is provided with an upper case 55 made of stainless steel, an insulated pad 20 inserted into the upper case 55, a lower case 140 covering lower portion of the insulated pad 20 and a pair of hinge assemblies 60 disposed on rear portions of opposite sides of the upper case 55. Two openings 254, 354 are formed in the rear portion of each side of the upper case 55, and three openings 52, 54, 154 are formed in a fore portion of each side of the upper case 55. In each side of the lower case 140, two openings 52, 54 are formed corresponding burring taps 142, 143. Each hinge assembly 60 is provided with a plate 70 having a threaded opening 76, a pair of insertion opening 72 and a welding opening 74 disposed between the insertion opening 72, and a first and a second hinge axles 66*a*, 66*b*. And each plate 70 is fixed on an inside surface of side of the upper case 55 by using a bolt 34 screwed through the opening 154 and the threaded opening 76. Moreover, the connection between the plate 70 and the inside surface of side of the upper case 55 is strengthened by welding them together through the welding hole 74. And the hinge axles 66*a*, 66*b* are provided with insertion portion 62*a*, 62*b*, respectively, i.e., end portions having a smaller diameter, which are inserted into and welded with the corresponding opening 254, 354 and insertion openings 72, and hinge axle portions 64*a*, 64*b* serving as hinge shafts. And the first hinge axles 66*a* are closer to a front portion of the cover 50 than the second hinge axles 66*b*. The lower case 140 is joined with upper case 55 by using the bolts 134 screwed through openings 52, 54 and into burring taps 142, 143.

Further, a reflecting layer, such as a mirror, is disposed on a bottom surface of the lower case 140, so that the ingredient foodstuff in the pan P can be seen through the reflecting layer when the cover 50 is opened.

As described above, since the first and the second hinge axles 66*a*, 66*b* are fixedly inserted into and welded with the insertion holes 72 formed in the plates 70 which are attached to the inside surfaces of opposite sides of the upper case, an assembling process of the cover 50 of the present invention is simplified and, therefore, the production cost of the hinge axles is reduced. Moreover, since the burring taps 142, 143 are used instead of rivet screws, the manufacturing process of the cover 50 is further simplified. And, since the bottom surface of the cover 50 reflects the ingredient foodstuff in the pan P, a foodstuff preparer easily finds what he or she intends to use without bending the waist.

Figure 5:
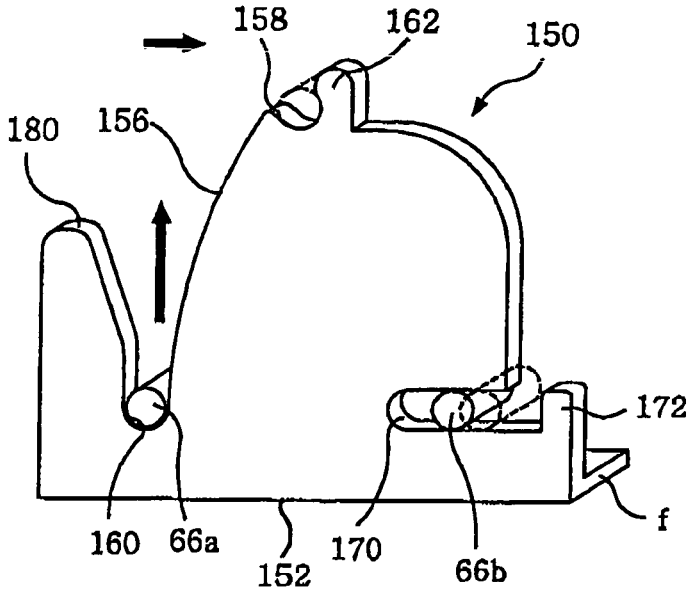
FIG. 5 sets forth a perspective view of a bracket of the present invention.

Referring to FIG. 5, there is illustrated a perspective view of a bracket of the present invention. The bracket 150 includes a bottom surface 152 having a flange f fixedly connected to the upper portion of the insulated wall 16 (See FIG. 3); a guide surface 156 which guides the first hinge axle 66*a* and is formed with a curved slant surface; a horizontally extended guide slot 170 which horizontally guides the second hinge axle 66*b* fitted thereinto; a latch slot 158 which is disposed at the highest portion of the guide surface 156 and prevents the first hinge axle 66*a* from sliding downward along the guide surface 156; a stopper 162 which prevents the first hinge axle 66*a* from moving over the latch slot 158 to keep the cover 50 from opening over a certain angle; a support portion 160 which is disposed at the lowest portion of the guide surface 156 to prevent the first hinge axle 66*a* from moving downward anymore; a front protrusion 180 which is connected to the support portion 160 and is opposite to the guide surface 156 with respect to the support portion 160 to prevent the first hinge axle 66*a* from moving forward; and a back protrusion 172 which is disposed on an end portion of the guide slot 170 to limit a backward movement of the second hinge axle 66*b*.

When the cover 50 is opened, the first hinge axle 66*a* slides upward along the guide surface 156 and the second hinge axle 66*b* slides horizontally in the guide slot 170. Since the guide surface 156 is a curved slant surface instead of a vertical surface and the guide slot 170 is a horizontally elongated opening instead of a slantingly extended opening, comparatively less force is required to open the cover 50. And the first hinge axle 66*a* is prevented from moving over the latch slot 158 by the stopper 162 under the condition that the cover 50 is opened at a certain angle. At this time, the first hinge axle 66*a* is restrained in the latch slot 158, so that the cover 50 is not accidentally closed.

Further, when the cover 50 is opened, an operator moves the hand upward and then forward, which makes the operation comfortable.

When the cover 50 is closed, the cover 50 is slightly lifted up such that the first hinge axle 66*a* is escaped from the latch slot 158 and then slided downward along the guide surface 156. Finally, the first hinge axle 66*a* comes into contact with the support portion 160 and the cover 50 is completely closed. At this time, the cover 50 comes into contact with the upper portion of the insulated wall 16.

As described above, since the guide surface 156 is a curved slant face and the guide slot 170 is a horizontally elongated opening, comparatively less force is required to open the cover 50 and the operator feels more comfortable in handling it. In addition, since the cover 50 comes into contact with the upper portion of the insulated wall 16 almost at the same time or slightly after the first hinge axle 66*a* comes into contact with the support portion 160, a hard collision between the cover 50 and the upper portion of the insulated wall 16 can be prevented.

Figure 6:
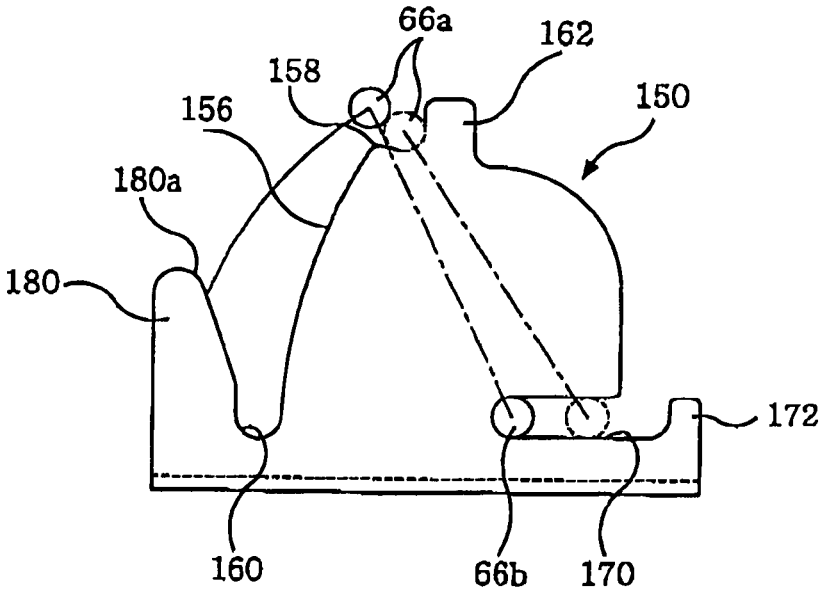
FIG. 6 shows paths of a first and a second axle.

Referring to FIG. 6, there are illustrated paths of the first and the second hinge axles 66*a*, 66*b* joined with the bracket 150 in a case where the cover 50 (See FIG. 3) is dropped accidentally so that the first hinge axle 66*a* does not slide along the guide surface 156 (See FIG. 3). When the cover 50 (See FIG. 3) is dropped from the latch slot 158 (See FIG. 3), the first hinge axle 66*a* is moved along a solid line and then collides with a slant portion 180*a* of the front protrusion 180 covered with an impact absorbing material, such as urethane. Thus, the speed of dropping cover 50 is reduced and then slides into the support portion 160. Consequently, it is prevented that the cover 50 severely collides with the upper portion of the insulated wall 16 (See FIG. 3).

While the invention has been shown and described with respect to the preferred embodiments, it will be understood by those skilled in the art that various changes and modifications may be made without departing from the spirit and scope of the invention as defined in the following claims.

What is claimed is:

1. A food preparation table, comprising:

a pan holder which accommodates pans containing ingredient foodstuff items;

an insulated wall surrounding the pan holder and having a flat top surface;

n brackets fixed on the insulated wall, n being an even number; and n/2 covers for covering or exposing the pan holder, each of the covers including:

two opposite sides;

a pair of first hinge axles which are attached on said two opposite sides, respectively; and a pair of second hinge axles which are attached on said two opposite sides, respectively, wherein the pair of first hinge axles are closer to a center portion of each of the covers than the pair of second hinge axles, and wherein the first and the second hinge axles are slidably engaged with two brackets among said n brackets and each of the brackets includes a guide surface for guiding one of the first axles, with said guide surface having a continuous curvature which is slanted in a direction toward the second hinge axles such that when the covers are opened, the covers will necessarily move upward and forward along the curved slant surface in the slanted direction.

2. The food preparation table of claim 1, wherein each of the brackets further includes a guide opening extended parallel with the top surface of the insulated wall for guiding one of the second hinge axles.

3. The food preparation table of claim 2, wherein each of the brackets further includes a support portion which is disposed at a lowest portion of the guide surface and prevents said one of the first hinge axles from moving downward to reduce impact occurring between the insulated wall and one of the covers which has said one of the first hinge axles.

4. The food preparation table of claim 3, wherein each of the brackets further includes a front protrusion which is connected to the support portion and is opposite to the guide surface with respect to the support portion, and wherein said one of the first hinge axles collides with the front protrusion when one of the covers which has said one of the first hinge axles is accidentally dropped.

5. The food preparation table of claim 4, wherein the front protrusion is provided with a slant surface which is formed on a side of the front protrusion facing the guide surface and is covered with an impact absorbing material, and wherein said one of the first hinge axles collides with the slant surface when one of the covers which has said one of the first hinge axles is accidentally dropped.

* * * * *